US005971715A

United States Patent [19]

Breslin

[11] Patent Number: 5,971,715

[45] Date of Patent: Oct. 26, 1999

[54] PNEUMATIC PUMP HAVING RADIAL BALL CHECK VALVE ARRAY

[75] Inventor: Michael K. Breslin, Mill Valley, Calif.

[73] Assignee: Clean Environment Engineers, Oakland, Calif.

[21] Appl. No.: 08/846,022

[22] Filed: Apr. 25, 1997

[51] Int. Cl.[6] ..... F04F 1/06

[52] U.S. Cl. ..... 417/131; 137/512.1

[58] Field of Search ..... 417/130, 131; 137/512.1

[56] References Cited

U.S. PATENT DOCUMENTS

| | | | |
|---|---|---|---|
| 1,587,877 | 6/1926 | Vaughn . | |
| 2,308,876 | 1/1943 | Hammett | 277/60 |
| 5,358,037 | 10/1994 | Edwards et al. | 166/105 |

*Primary Examiner*—Timothy S. Thorpe
*Assistant Examiner*—Ehud Gartenberg
*Attorney, Agent, or Firm*—Townsend and Townsend and Crew LLP

[57] ABSTRACT

In a pneumatic pump of the float actuated variety, a radial check valve array is utilized for minimizing the trigger point of the pump relative to the bottom of the leachate and/or groundwater table. The pump includes a fluid-tight casing from which fluid to be pumped can be discharged to an outflow conduit such as a well casing. An outflow conduit extends from a outflow conduit inlet at the bottom inside of the fluid-tight casing to a pumped fluid discharge—such as a well casing—exterior of the casing. An actuating float is disposed within the pump casing and is moveable over a distance responsive to liquid level within the casing from a first lower position adjacent the bottom of the casing to a second upper position for actuating an air inlet to discharge air into the casing. An air inlet check valve is provided having an inlet for communication to a source of air under pressure exterior of the pump casing and an outlet to the interior of the pump casing. Inlet of fluid to be pumped to the interior of the pump casing from the exterior of the pump occurs through the radial check valve array. The array functions to surround the outflow conduit of the pump to enable the outflow conduit and check valve array to overlap, reducing the minimum trigger depth of the pump.

10 Claims, 4 Drawing Sheets

PNEUMATIC PUMP HAVING RADIAL BALL CHECK VALVE ARRAY

This invention relates to a float actuated pneumatic pump. Specifically, a float actuated pneumatic pump is disclosed utilizing a radial check valve array. The pump has the advantage of lowering the so-called "trigger" distance for the pump. This enables the pump to maintain a minimum groundwater table under the pump. In environmental applications, such as the pumping of leachate under landfill, leachate may be maintained in minimum volume for optimum aeration of landfill sites.

BACKGROUND OF THE INVENTION

Landfill sites are utilized for the disposal of waste. In the usual case, the landfill site is required to have a water-impermeable bottom. Oxygenated groundwater or leachate is circulated through the landfill. Sometimes the leachate is sprayed onto the top of the landfill site and is oxygenated during the spraying process. This oxygenated water or leachate then passes through the material of the landfill and causes desired oxidation with accompanying desired decomposition of materials within the landfill. Typically, the decomposition produces methane gas, which can be a useful by-product of the landfill site.

There is a requirement that the leachate within the landfill site be pumped. Otherwise, the leachate will fill the site, lose its oxygen content to the oxygen demanding environment of decomposing material of the landfill, and thereafter prevent the desired circulation of oxygenated water through the landfill. By the expedient of pumping the leachate from the water-impermeable bottom of the landfill, aerating the leachate by passing the leachate through conventional sprinklers, and allowing the leachate to recirculate through the landfill, systematic and desired decomposition of the materials within the landfill occurs.

Pneumatic pumps are often preferred relative to electric pumps in such landfill applications for several reasons. First, in landfill applications, it is not possible to predict the flow rate at any individual pump. Pneumatic pumps can accommodate a wide range of flow rates; electric pumps are more restricted due to the fact that their driving motors are usually run at a constant speed.

Secondly, the leachate contains particulate matter. Pneumatic pumps are much more tolerant of particulate matter than electric pumps. Electric pumps can jam or wear excessively when encountering particulate matter; pneumatic pumps can undergo one or more imperfect cycles and then pass the particulate matter through the pump.

Third, the flow of the leachate is not always constant. The flow can either be extremely low or erratic. Electric pumps in accommodating periods of low flow often start and stop frequently. This can and does cause such pumps to become overheated and burn out.

Fourth, leachate can be extremely corrosive. Electric pumps with their required electrical connections accommodate the corrosive leachate with difficulty; pneumatic pumps because of their simplicity can be given a higher tolerance to the corrosive leachate.

Fifth, electrical connections are difficult to install in landfill sites. Specifically, the electrical connections must pass across landfill sites to each well site. Because of the dynamic decomposition occurring, levels of the landfill constantly change requiring constant attention to rerouting of the electrical connections. Further, and because of the content of the landfill, the leachate is frequently conductive.

As a consequence, down-hole electrical connections in the individual wells to power such pumps are much more difficult to maintain than pneumatic connections.

As applied to landfill leachate recirculation, pneumatic pumps have a serious drawback. Typically, it is desired to have the input to such pneumatic pumps as close to the bottom of the landfill leachate groundwater table as possible. The pneumatic pumps of choice operate on a "float-triggering" principle in connection with a lever and stainless steel poppet air valve (see U.S. Pat. Nos. 5,487,647 (Breslin); 5,358,038 (Edwards, et al.); and 5,358,037 (Edwards, et al.)). The float vertically reciprocates from a lower, intake position to an upper, pump actuation position in response to the level of leachate which enters the pump from the soil immediately surrounding the pumps. While an electric pump can have an inlet immediate to the bottom of the groundwater table, pneumatic pumps because of the requirement of float actuation must have a so-called "trigger depth." This trigger depth is the required submergence of the pump necessary to actuate a pump cycle.

The necessity of this trigger depth requires a static head of leachate of a minimum depth before a pumping cycle can be initiated. Unfortunately, the greater the trigger depth, the larger the volume of leachate which is maintained at the bottom of the landfill. It is desired to keep the volume of leachate at the bottom of the landfill site to a minimum. With current intake check valve designs on such pumps, trigger depths are over 12 inches. Certain laws now require such trigger depths to be 12 inches or less.

In the disclosure that follows, I utilize a radial check valve array to lower the trigger depth of a pneumatic pump. The reader will understand that although such radial check valve arrays are known, they have not been utilized or suggested to be utilized for lowering the trigger depth of pneumatic pumps. This is especially true as these pneumatic pumps are applied to the problem of leachate in landfill sites. Accordingly, I claim invention in this combination.

SUMMARY OF THE INVENTION

In a pneumatic pump of the float actuated variety, a radial check valve array is utilized for minimizing the trigger depth of the pump relative to the bottom of the leachate and/or groundwater table. The pump includes a fluid-tight casing from which fluid to be pumped can be discharged to an outflow conduit such as a well casing. An outflow conduit extends from an outflow conduit inlet at the bottom inside of the fluid-tight casing to a pumped fluid discharge—such as a well casing—exterior of the casing. An actuating float is disposed within the pump casing and is moveable over some portion of the trigger depth responsive to liquid level within the casing from a first lower position adjacent the bottom of the casing to a second upper position for actuating an air inlet to discharge air into the casing. An air inlet check valve is provided having an inlet for communication to a source of air under pressure exterior of the pump casing and an outlet to the interior of the pump casing. Inlet of fluid to be pumped to the interior of the pump casing from the exterior of the pump occurs through the radial check valve array. The array functions to surround the outflow conduit of the pump to enable the outflow conduit and check valve array to overlap, reducing the minimum trigger depth of the pump.

The radial check valve array can be at the bottom of the pump. Alternatively, the radial check valve array may be placed at the top of the pump casing adjacent to the trigger point of the pump. In either event, because the check valve array can be configured around the outflow conduit, reduction of the trigger depth of the pneumatic pump occurs.

DESCRIPTION OF THE PREFERRED EMBODIMENT

Figure 1A:
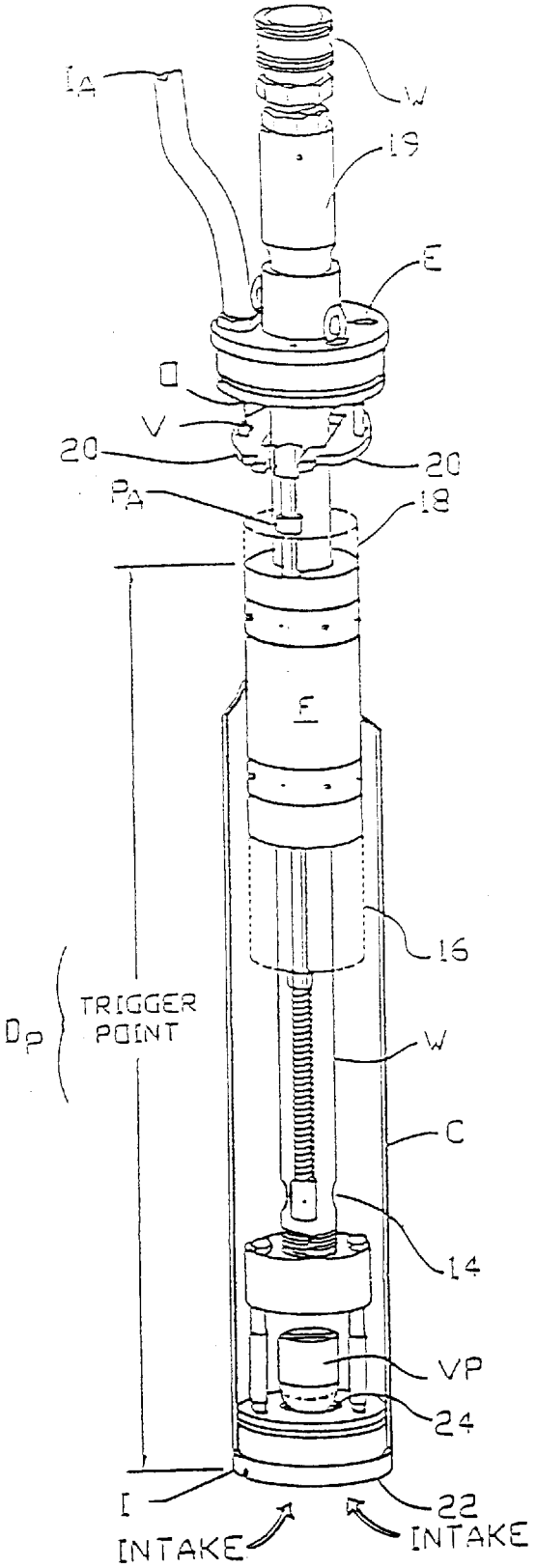
FIG. 1A is a side elevation perspective of a prior art pneumatic pump illustrating the pump with a bottom intake having a single, central check valve for admitting fluid to be pneumatically pumped interior of the pump casing from the bottom of the casing, with the depth required for "triggering" the pump being illustrated vertically to the side of the pump.

Referring to the prior art as set forth in FIG. 1A, the operation of a prior art pneumatic pump $P_A$ will first be set forth. The so-called "trigger depth" D will be identified. Thereafter, the conventional construction of such prior art pneumatic pump $P_A$ will be discussed, and a description of the preferred embodiments of this disclosure will be set forth.

Referring to FIG. 1A, prior art pneumatic pump $P_A$ is illustrated. This pump has a fluid-tight casing C having outflow conduit W communicated within fluid-tight casing C to the bottom of the fluid-tight casing. It will be realized that the fluid-tight casing is not completely illustrated but is shown in FIG. 1A so that ready understanding of the disclosure may occur.

Outflow conduit W has conduit inlet 14 interiorly of fluid-tight casing C adjacent the bottom. Outflow conduit W typically communicates to a well casing (not shown) for discharge of the pumped fluid, such as leachate.

Actuating float F within fluid-tight casing C is here shown configured about outflow conduit W. As fluid enters casing C, actuating float F moves from first lower position 16 (shown in broken lines) adjacent the bottom of fluid-tight casing C to a second upper position 18 for actuating inlet valve V to discharge air into fluid-tight casing C.

Inlet valve V has air inlet $I_A$ for communication to the source of air under pressure and an outlet O (hidden from view) to fluid-tight casing C of prior art pneumatic pump $P_A$. Actuating float F causes valve plate 20 to flip to permit the flow of pressurized air from air inlet $I_A$ to outlet O. Pushing fluid through conduit opening 14, up conduit W, through outlet check valve 19 and out of the pump P.

Finally, prior art check valve $V_P$ is at the bottom of prior art pneumatic pump $P_A$. This prior art check valve $V_P$ has inlet 22 exterior to the casing, outlet 24 to the casing, and movable stopper 24 within prior art check valve $V_P$ for preventing flow from outlet 24 to inlet 22.

Operation is easy to understand. Refer to U.S. Pat. Nos. 5,487,647 (Breslin); 5,358,038 (Edwards, et al.); and 5,358,037 (Edwards, et al.). Presuming that prior art pneumatic pump $P_A$ is placed within a fluid to be pumped, as fluid rises from inlet I to the top of trigger depth $D_P$, actuating float F rises. Actuating float F pushes on stop S which causes control rod R to flip valve plate 20, causing air inlet valve V to actuate, admitting air under pressure from air inlet $I_A$ to fluid-tight casing C. Prior art check valve $V_P$ closes. Fluid to be pumped is forced interior of fluid-tight casing C to conduit inlet 14 out of the interior of fluid-tight casing C. Pumping results.

It is notable that the radial ball check valve array A can have channels of flow constructed therein to enable conduit inlet 14 to be lowered interior of radial ball check valve array A to possibly shorten trigger depth $D_P$ even further.

Figure 1B:
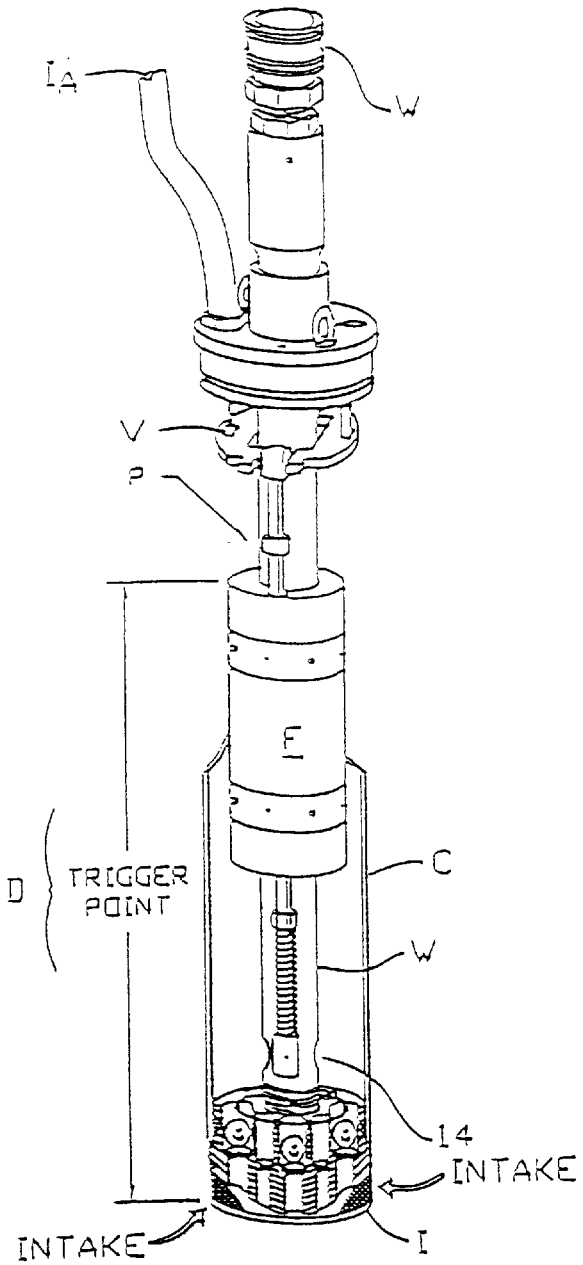
FIG. 1B is a side elevation perspective of the pneumatic pump of this disclosure with a radial check valve array placed at the bottom of the pump with the depth required for "triggering" the pump being illustrated vertically to the side of the pump.

Referring to FIG. 1B, the disclosure can be understood. Specifically, radial ball check valve array A is shown arrayed around conduit inlet 14 to outflow conduit W. With this configuration, trigger depth D can be reduced.

In understanding of this disclosure, various constructions of radial ball check valve array A will be discussed with respect to FIGS. 2A, 2B and 2C. Thereafter, various pump inlet locations will be discussed with attention successively addressed to FIG. 1B, and FIG. 3B. Details of these respective valves will be set forth with respect to FIG. 4A and 4B.

Figure 2A:
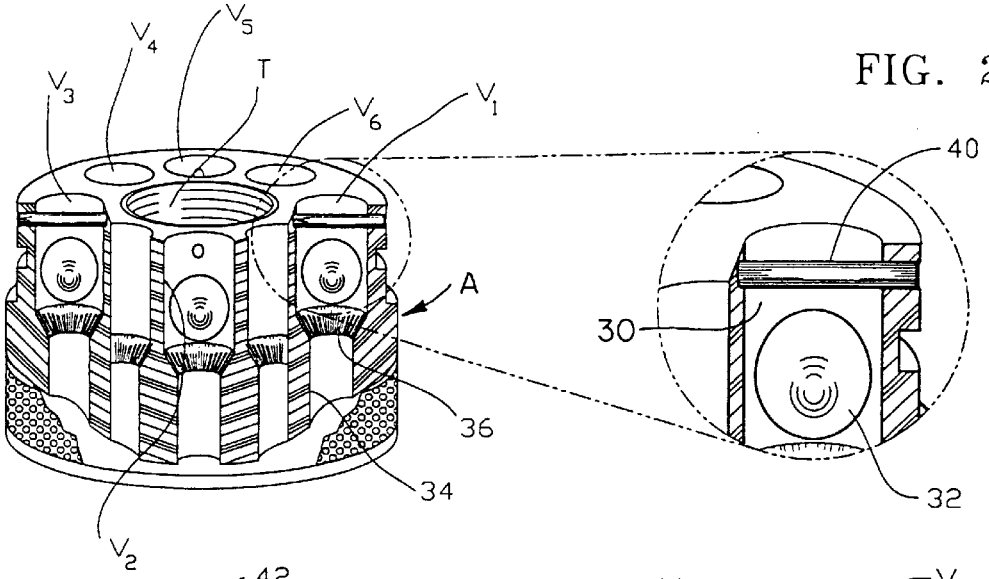
FIGS. 2A, 2B and 2C illustrate radial check valve arrays with FIG. 2A illustrating a check valve array held in place by ball-capturing pins, FIG. 2B illustrating a check valve array with the balls held in place by a single continuous ring, and FIG. 2C illustrating the preferred ball check valve array with a single spring holding the balls of the check valve array in place.

Referring to FIG. 2A, radial ball check valve array A is shown. Radial ball check valve array A is here shown having a cluster of check valves $V_1$–$V_6$. Taking the case of check valve $V_1$, it will be seen that it includes upper large bore 30 for accommodating ball 32 and providing clearance between ball 32 and upper large bore 30 to permit the flow of fluid. Lower small bore 34 is shown having a diameter less than ball 32. Between lower small bore 34 and upper large bore 30 there is frustum-shaped ball seat 36.

Operation of each valve of cluster of check valves $V_1$–$V_6$ is well known. Ball 32 functions to permit fluid to flow from lower small bore 34 to upper large bore 30 but not from upper large bore 30 to lower small bore 34. As can be understood, any single valve of the cluster of check valves $V_1$–$V_6$ would provide insufficient flow for pneumatic pump P; however, radial ball check valve array A has a cluster of check valves $V_1$–$V_6$ radially arrayed that combine to permit sufficient flow for operation.

As has been emphasized, each valve of cluster of check valves $V_1$–$V_6$ is vertically aligned and radially arrayed. This defines central aperture T. Simply stated, by placing conduit W within radial ball check valve array A at central aperture T, trigger depth D is reduced. This occurs because the check valve ball 32 movement is no longer below the end of conduit W, as in prior art, but alongside, thus using the valuable vertical space more efficiently.

Figure 2B:
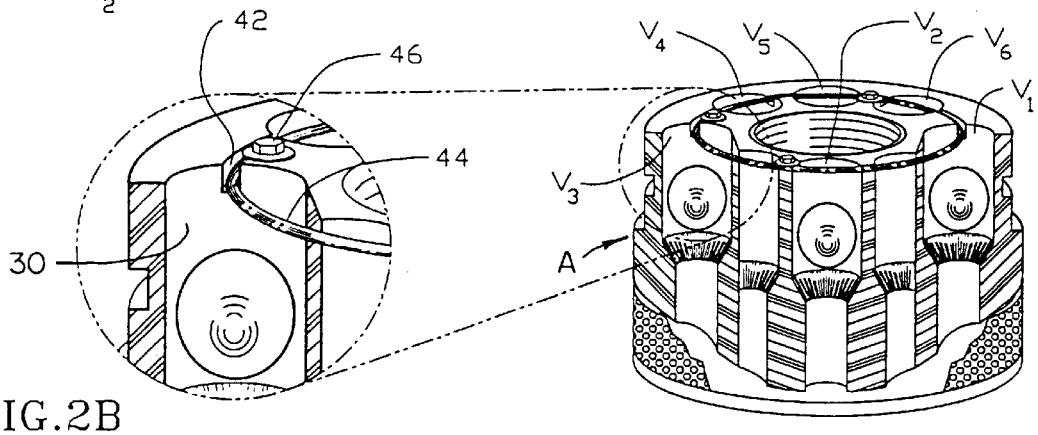
Figure 2C:
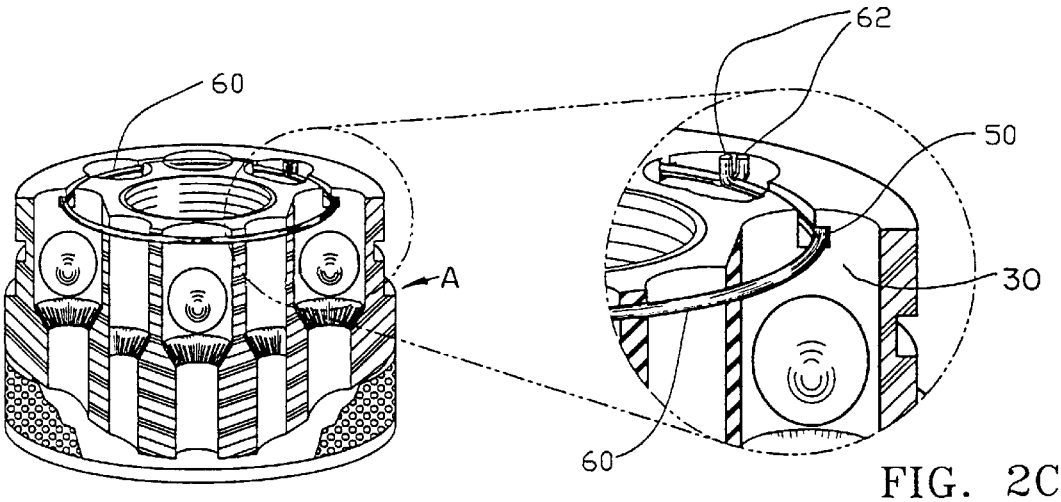

FIGS. 2A–2C differ only in the matter that ball 32 is retained within upper large bore 30. Referring to FIG. 2A, conventional cross pin 40 is shown lodged over each upper large bore 30 of cluster of check valves $V_1$–$V_6$. With reference to FIG. 2B, it will be seen that radial ball check valve array A has circular slot 42 configured within radial ball check valve array A. By the expedient of placing circular ring 44 within circular slot 42 and holding circular ring 44 in place with bolt and washer 46, the single ring 44 serves to hold all balls 32 in place in cluster of check valves $V_1$–$V_6$.

FIG. 2C illustrates the preferred construction of radial ball check valve array A. Array A has L-shaped groove 50 placed within radial ball check valve array A. Circular spring clip 60 is placed within and expanded within L-shaped groove 50 so that circular spring clip 60 occupies the bottom outward projecting portion of L-shaped groove 50. This insertion is accomplished by compressing circular spring clip 60 at upwardly projecting tangs 62 and fitting the ring to L-shaped groove 50. When circular spring clip 60 is at the bottom L-shaped section of L-shaped groove 50, upwardly projecting tangs 62 are released, and circular spring clip 60 expands, locking itself interior of L-shaped groove 50. It will be understood, that I claim invention as to the radial check valve array shown in FIGS. 2B and 2C.

It will be understood that radial ball check valve array A can be placed anywhere along the length of outflow conduit W within fluid-tight casing C. In FIG. 1B, I show radial ball check valve array A at the bottom of fluid-tight casing C. This embodiment allows pneumatic pump P of FIG. 1B to pull leachate to the very bottom of a site being pumped, such as a landfill site. It will be understood that this design causes pneumatic pump P to intake a higher content of particulate matter. Accordingly, it may be desired to move radial ball check valve array A to the top of fluid-tight casing C. This configuration is illustrated in FIG. 3B.

Figure 3A:
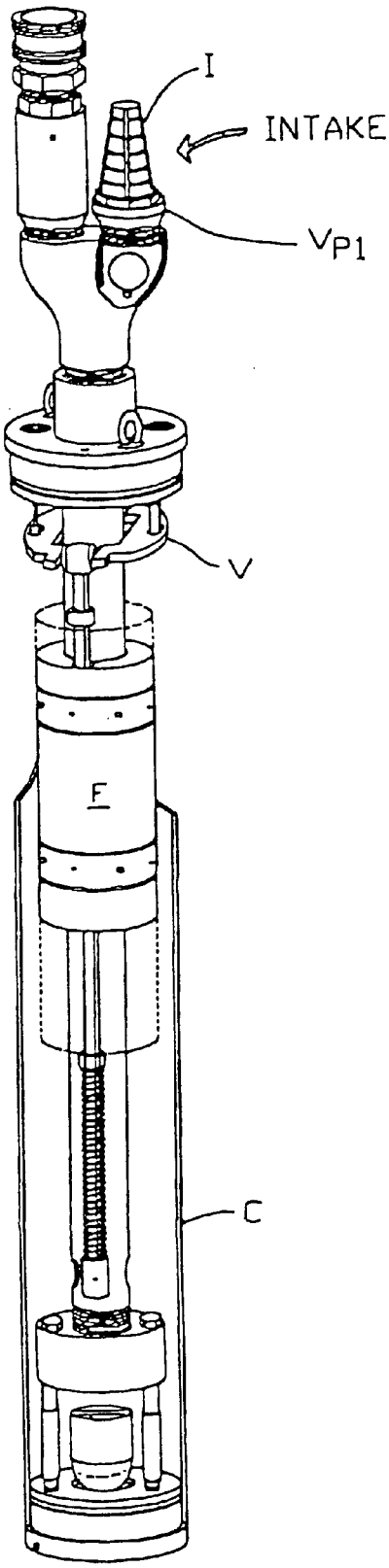
(PRIOR ART) FIG. 3A
FIG. 3A illustrates a prior art pneumatic pump with the intake at the top of the pump where the pump includes a single central ball for governing fluid intake.
Figure 3B:
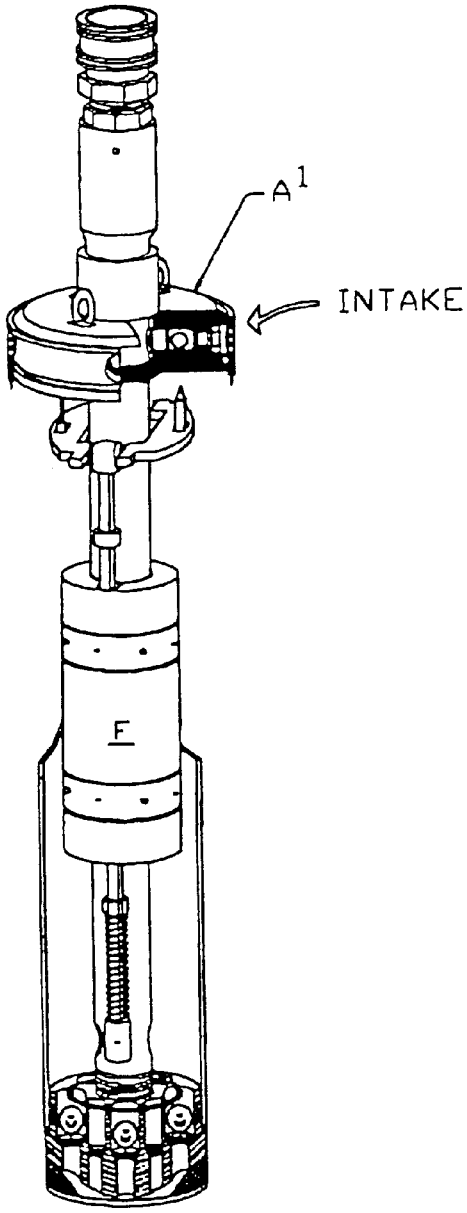
FIG. 3B illustrates a pneumatic pump utilizing this disclosure having a radial check valve array with the valves horizontally aligned to produce a minimized trigger depth for the pneumatic pump.

Before discussing the configuration shown in FIG. 3B, some attention can be devoted to the prior art pump configuration shown in FIG. 3A.

Referring to FIG. 3A, prior art check valve $V_{P1}$ is shown at the top of fluid-tight casing C. Providing that fluid to be pumped rises to the height of inlet I, function of prior art pneumatic pump $P_{A1}$ is identical to that described for prior art pneumatic pump $P_A$ in FIG. 1A.

Referring to FIG. 3B, radial ball check valve array A' is illustrated. Several differences will be noted over radial ball check valve array A illustrated with respect to FIGS. 1B, 2A–2C. First, the axis of each of the radial check valves is horizontal, and not vertical. Second, the valves are arrayed in polar alignment with the intake on the outside and the inlet on the inside. Finally, the respective radial ball check valve array A' is at the top of fluid-tight casing C, and not at the bottom.

Figure 4A:
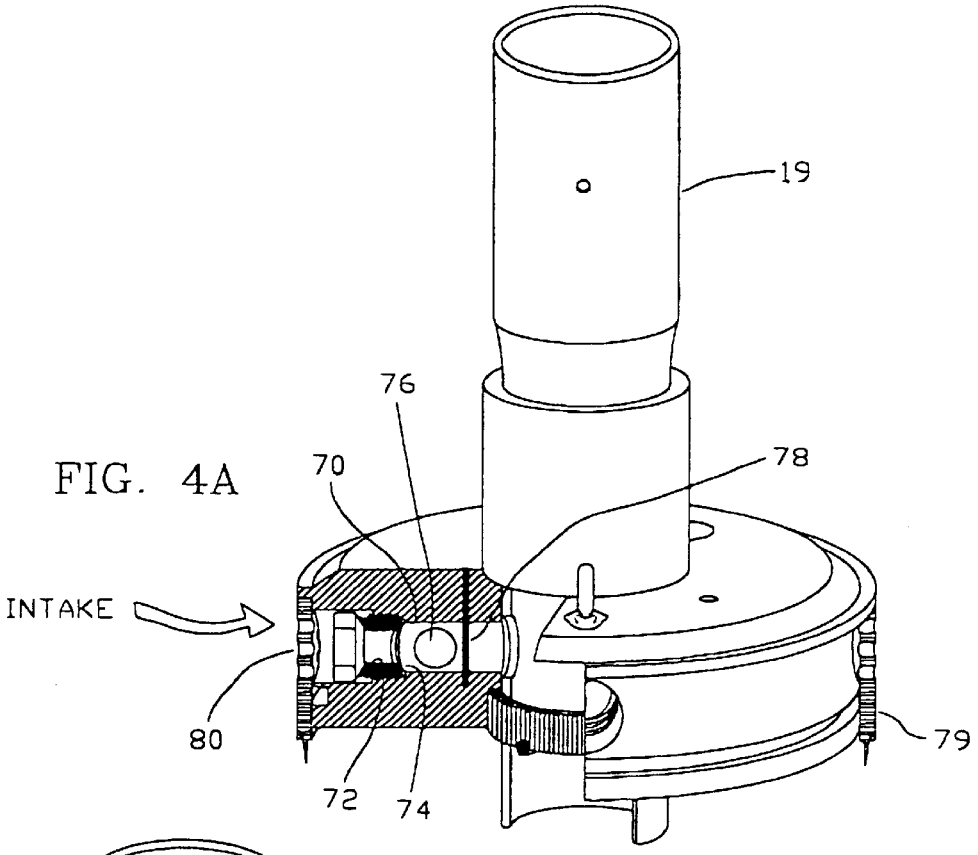
FIG. 4A is a perspective detail taken at the top of the pump illustrating the radial check valve array with the check valve actuated along a horizontal axis; and, FIG. 4B is a perspective detail taken at the top of the pump illustrating the radial check valve array with the check valves being actuated along a vertical axis.

Referring to FIG. 4A, it will be seen that inside large bore 70 and outside small bore 72 having frustum-shaped seat 74 therebetween. Ball 76 seats on frustum-shaped seat 74 when pumping occurs. Retention of ball 76 occurs at pin 78. To guard against overlarge particulate matter from entering the pump, band 79 is configured with screen apertures 80.

Figure 4B:
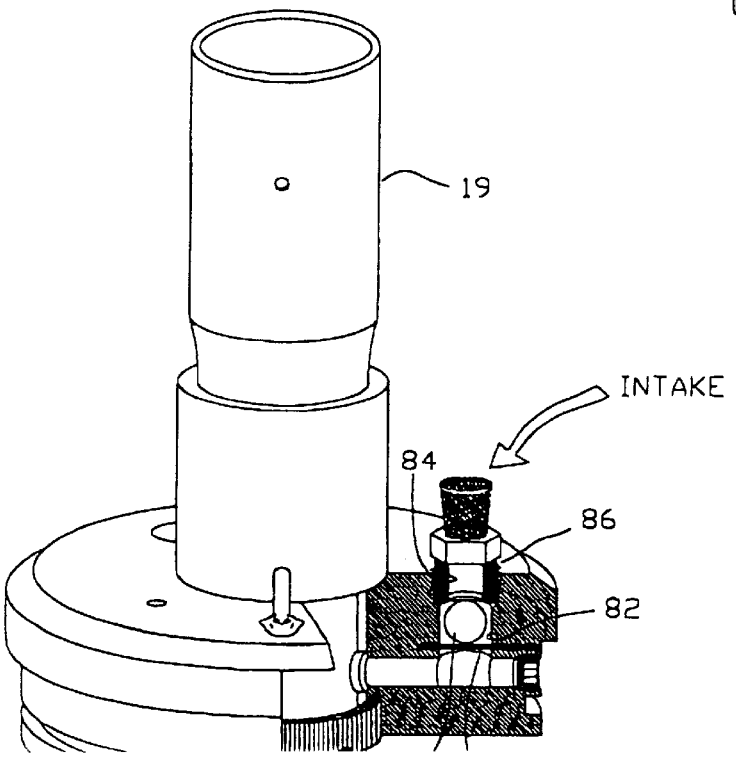

Referring to FIG. 4B, a check valve radially arrayed is shown with a vertical axis. Lower large bore 82 is shown with upper small bore 84 and frustum-shaped seat 86 therebetween. As before pin 88 acts to retain ball 90 within lower large bore 82. Overlying upper small bore 84 there is provided screen 92 again to prevent the entrance of overlarge particulate matter.

Only one valve is shown in the illustrations of FIGS. 4A and 4B. The reader will understand that a plurality of such valves in each embodiment is preferred.

What is claimed is:

1. In a pneumatic pump having:

a fluid-tight casing having a bottom and a top, an outflow conduit communicated to the fluid-tight casing at one end, extending coaxially of the casing, and adapted for connection to a discharge pipe, the outflow conduit incorporating an outlet check valve for preventing fluid flow back into the fluid-tight casing;

an actuating float within the fluid-tight casing moveable over the outflow conduit along an excursion path for actuating the pump from a first lower position adjacent the bottom of the casing to permit fluid tight casing flooding to a second upper position adjacent the top of the fluid-tight casing for actuating an inlet to discharge air into the fluid-tight casing;

an air inlet valve having an inlet for communication to a source of air under pressure, an outlet to the fluid-tight casing of the pump, and means between the inlet and outlet for permitting flow pressurized air from the inlet to the outlet; and, an inlet check valve having an inlet exterior of the fluid-tight casing, an outlet to the fluid-tight casing, and means within the check valve for preventing flow from outlet to inlet;

an improvement to the inlet check valve comprising:

a plurality of check valves mounted in a radial array, the check valves having individual inlets exterior of the fluid-tight casing, individual outlets interior of the fluid-tight casing, the radial array of the plurality of check valves disposed around the outflow conduit of the pumps, and disposed immediately adjacent the excursion path of the float whereby the plurality of check valves mounted in the radial array overlaps the outflow conduit to minimize the distance from the radial array of check valves to the excursion path of the actuating float.

2. The pneumatic pump according to claim 1 and further including:

said plurality of check valves mounted in a radial array having their respective inlets and outlets vertically aligned.

3. The pneumatic pump according to claim 1 further including:

said plurality of check valves mounted in a radial array having their respective inlets and outlets horizontally aligned.

4. The pneumatic pump according to claim 1 further including:

the radial check valve array mounted at the bottom of the fluid-tight casing.

5. The pneumatic pump according to claim 1 further including:

the radial check valve array mounted at the top of the fluid-tight casing.

6. A radial check valve array comprising in combination:

a radial array of vertically disposed check valve bodies, each said check valve body including, an upper large diameter bore;

a lower smaller diameter bore;

a seating surface defined between the upper large diameter bore and the lower small diameter bore;

a ball in each valve body having a diameter to allow free movement within the upper large diameter bore and having a diameter restricting entry to the lower small diameter bore; and, a circular wire intersecting the upper large diameter bore to capture the ball within the upper large diameter bore overlying the seating surface.

7. A radial check valve array according to claim 6 wherein:

the circular wire is continuous.

8. A radial check valve array according to claim 6 wherein:

the circular wire has two ends with a circular portion of the wire being disposed between the ends.

9. A radial check valve array according to claim 6 wherein:

radially arrayed vertically disposed check valve bodies define an L-shaped groove with a top of the L-shaped grove for receiving the circular wire and a bottom of the L-shaped groove being disposed radially distant from the top of the L-shaped groove; and, the circular wire is spring biased to the bottom of the L-shaped groove.

10. A radial check valve array according to claim 6 wherein:

the circular wire is spring biased to a radial outside of the L-shaped groove.

* * * * *